US007252404B1

(12) United States Patent
Messamore

(10) Patent No.: US 7,252,404 B1
(45) Date of Patent: Aug. 7, 2007

(54) TOOLBOX WITH POWER SUPPLY

(76) Inventor: Douglas J. Messamore, 814 Calle Camellia St., Camarillo, CA (US) 93010

( * ) Notice: Subject to any disclaimer, the term of this patent is extended or adjusted under 35 U.S.C. 154(b) by 173 days.

(21) Appl. No.: 11/207,390

(22) Filed: Aug. 19, 2005

(51) Int. Cl.
*B25H 3/02* (2006.01)
*F21V 33/00* (2006.01)

(52) U.S. Cl. ..... 362/154; 362/132; 312/277

(58) Field of Classification Search ..... 362/154, 362/155, 156, 134, 132; 206/372, 373; 312/902, 312/244, 277
See application file for complete search history.

(56) References Cited

U.S. PATENT DOCUMENTS 3,231,730 A 1/1966 Wagner
4,976,450 A * 12/1990 Ellefson ..... 280/79.11
5,005,710 A * 4/1991 Hofer ..... 211/70.6
5,219,446 A 6/1993 Klepac
5,459,648 A * 10/1995 Courtney ..... 362/154
5,624,029 A * 4/1997 Shih ..... 206/372
5,685,421 A * 11/1997 Gilmore ..... 206/216
D389,593 S 1/1998 Shiao
5,779,350 A 7/1998 Chang
5,803,586 A 9/1998 Velez et al.
D410,760 S 6/1999 Yao
6,176,593 B1 1/2001 Spitler et al.
6,254,251 B1 7/2001 Washington
6,360,891 B1 3/2002 Rideout
2002/0179472 A1 12/2002 Lee

* cited by examiner

*Primary Examiner*—Alan Cariaso
*Assistant Examiner*—Leah S. Lovell
(74) *Attorney, Agent, or Firm*—Lawrence J. Gibney, Jr.

(57) ABSTRACT

This is a toolbox, which combines many features and which will allow the worker to simply carry one toolbox into an area and effectuate all repairs. It will provide a means to provide illumination for any areas, which are poorly or dimly lit.

8 Claims, 3 Drawing Sheets

TOOLBOX WITH POWER SUPPLY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

This is a toolbox, which fits in very tight or cramped places. It will be equipped with a source of lighting as well as a means to plug the toolbox into an electrical power source for illumination and to operate tools. It will also store a variety of tools, and store other equipment such as burners and brazers, which may be needed in a particular operation.

B. Prior Art

There are other devices, which make toolboxes more versatile and those include boxes, which have lighting sources as well as connections for power sources. However, they do not combine all of the unique features of this particular device into one unit. Representative examples of the prior art include Washington, U.S. Pat. No. 6,254,251, Wagner, U.S. Pat. No. 3,231,730, and Chang, U.S. Pat. No. 5,779,350.

BRIEF SUMMARY OF THE INVENTION

In certain circumstances a worker must go into tight or cramped spaces such as attics or crawlspaces. Unfortunately, when a worker is repairing a particular device in an attic, it is oftentimes very cramped, poorly lit and remote from any power source. This particular toolbox combines unique attributes and allows the worker to make one trip into the attic, access a power source and finish his job in an efficient manner without needing to make multiple trips for tools, supplies or to connect to power sources.

It is an object of this invention to incorporate as many features of the toolbox including lighting, storage capacity, as well as access to a power source in one unit. It is a further object of this device to make it designed so that it fits in tight or cramped spaces and still allow the worker to complete the necessary task at hand. It is an object of this device to save the worker time, and therefore money when completing a task.

DETAILED DESCRIPTION OF THE EMBODIMENT

Figure 1:
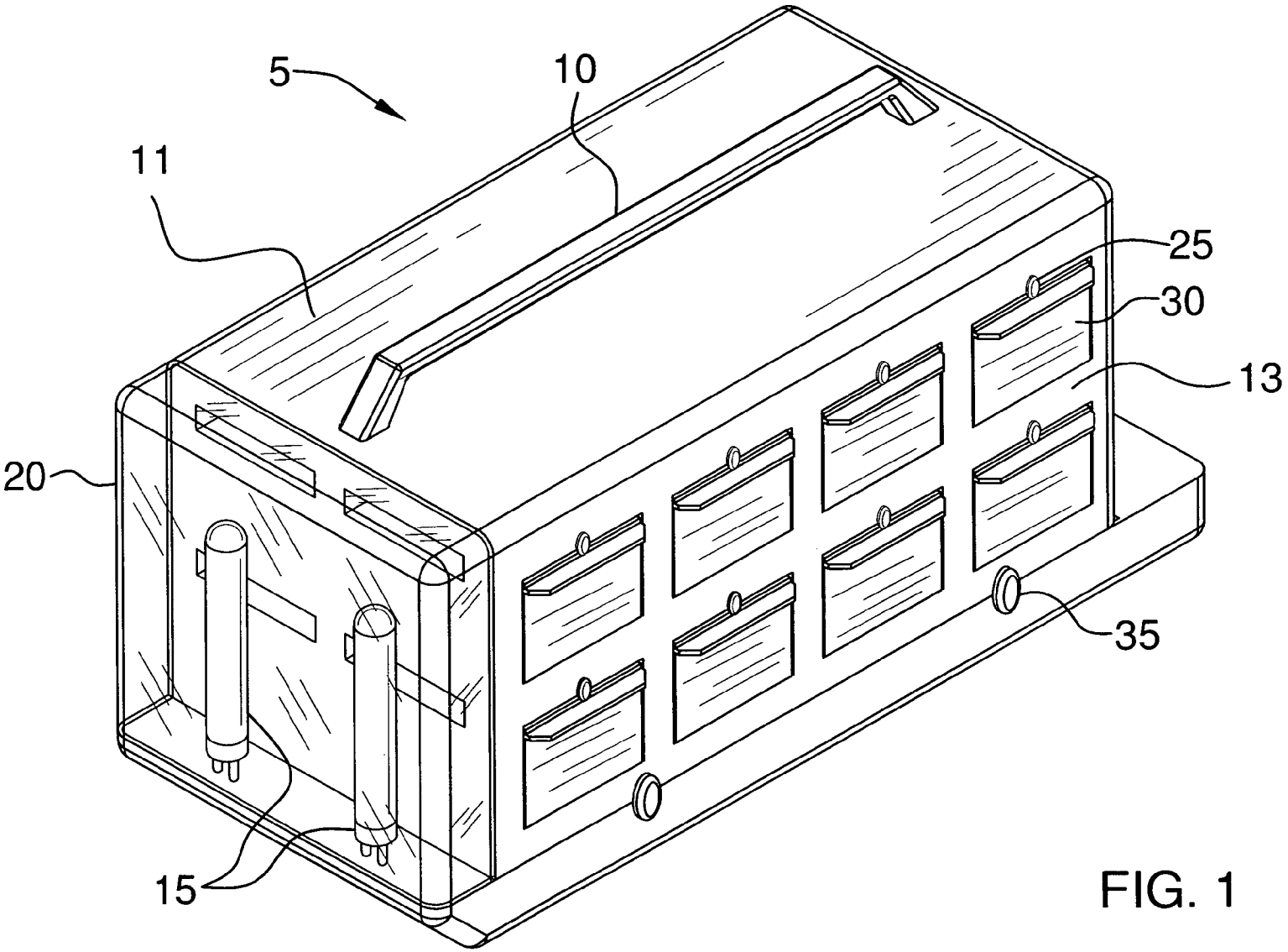
FIG. 1 is a perspective view of the device.
Figure 2:
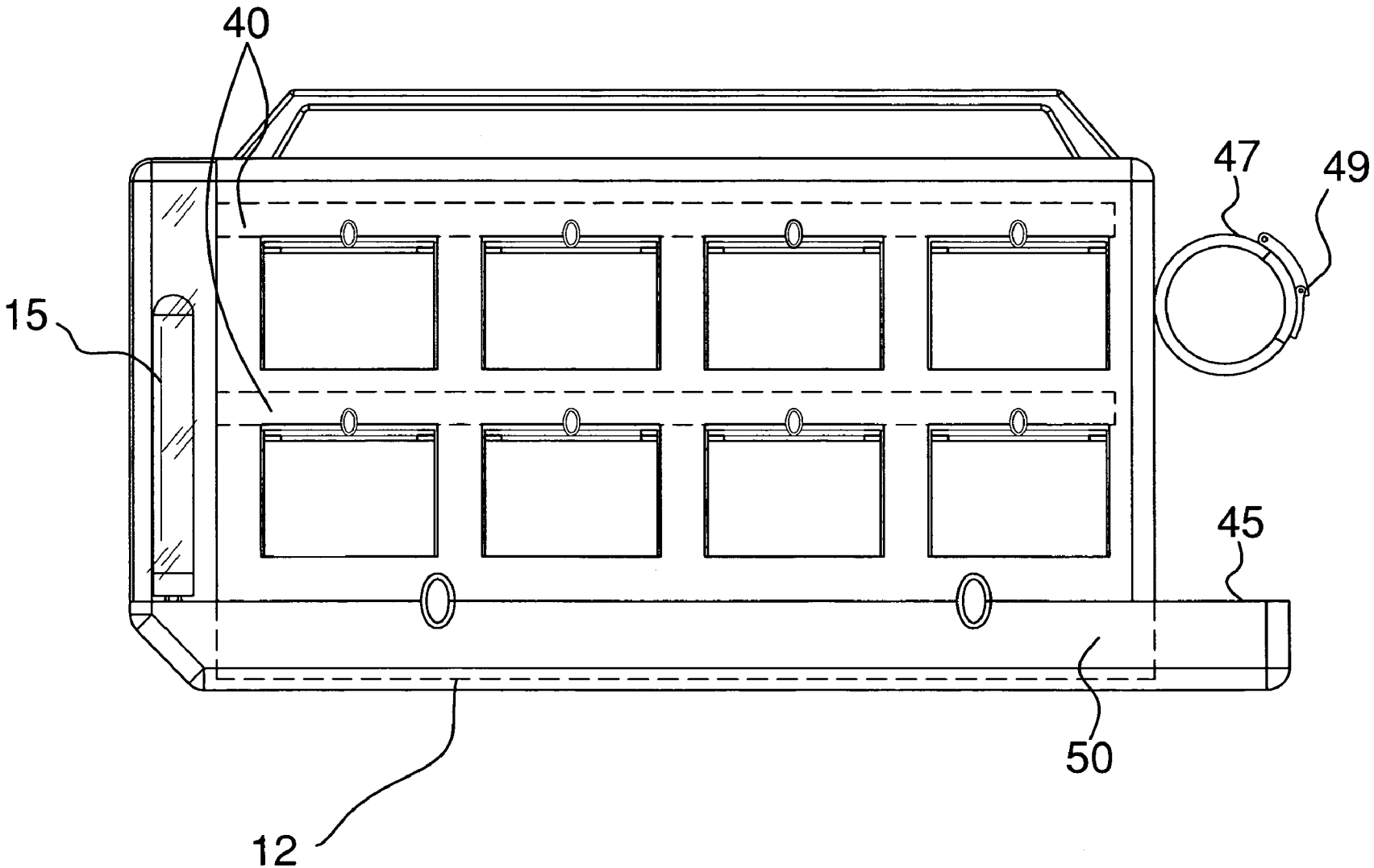
FIG. 2 is a front view of the device.

In FIG. 1, the toolbox is shown. It has a top surface 11, a bottom surface 12, and four side surfaces-two short 14 and two long 13. The basic shape of the toolbox 5 is a rectangle. A handle 10 is provided on the top surface 11.

On one end of the short 14 surfaces is a lighting source 15 and a means to attach the lighting source. Fluorescent lighting is preferable, although incandescent lighting can certainly be used. A clear cover 20, covers the lighting source 15 to prevent damage to the light source 15, and yet allow appropriate illuminating with the lighting source.

On one of the long sides 13 are latches 35, which can disconnect the toolbox from the base or shelf 50, upon which it sits. This allows for greater versatility of the toolbox and also allows the toolbox to fit in cramped spaces, if necessary. This feature would make the device 5 even more portable in those areas where it becomes necessary. The base 50 is a flat surface, which can be used independent of the toolbox 5 in the event that a flat surface is needed.

On the opposite short side 14 from the fluorescent lighting source 15 is a propane tank holder 47 with corresponding propane torch holder latch 49. Propane tanks are used commonly in brazing operations and therefore this is a necessary piece of equipment particularly for plumbers and those engaged in heating and air-conditioning system repair work. The propane holder latch 49 is circular to accommodate the usual shape of a propane tank. The propane holder latch 49 will also have a locking mechanism to insure that the propane tank does not fall from the unit. Additionally, when the base 50 is connected to the toolbox 5, a shelf 45, which is flat, is provided. This small flat shelf 45 will allow the worker to place an object being burned or braised on a flat surface for appropriate repair work. This shelf 45 is located below the propane holder latch 49.

On one of the long sides 13 is a plurality of latches 25, which opens a set of drawers 30. The drawers 30 may be used to store other implements to assist the worker in effectuating a particular repair. The specific design of the drawers is not material to this invention, other than those drawers provide storage space for commonly used tools or supplies. Additionally the specific tools or supplies, which are stored in the drawers 30, would vary with the particular job or task at hand or the particular preference of the worker.

Figure 3:
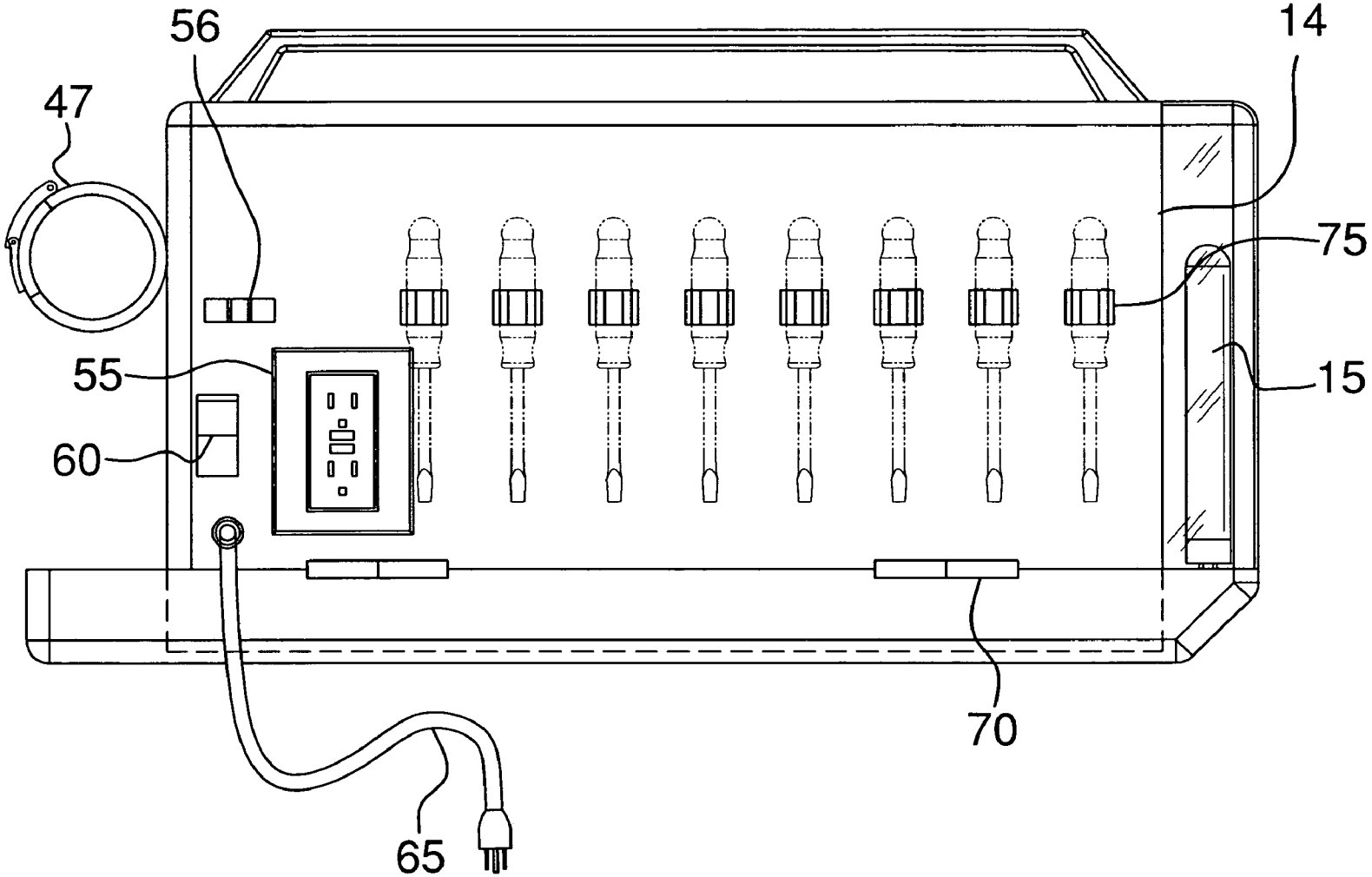
FIG. 3 is a back view of the device.

On the opposite long side 13 from the drawers 30 a plurality of holder clips or tool storage devices 75 is provided. The tool requirements for a particular trade will dictate the types of tools that are used with this device and are stowed on the tool storage devices 75. Some examples may include screwdrivers, pliers, and wrenches. The specific storage requirements for the holder clips 75, is not being claimed other than the ability to stow certain commonly used tools. In FIG. 3, holder clips 75 are depicted although other types of clips may be used to store different types of tools.

Additionally hinges 70, which are located on the bottom surface 12 of the toolbox 5 allows the base 50 to be removed from the toolbox and be independent of the toolbox when desired.

The handle 10, which is located on the top surface 11, is molded to the top surface 11 and is used to carry the toolbox 5.

In order to access a power supply for this particular device, a power cord 65 on one side allows power to enter the toolbox. A separate switch 60 allows a power to flow to the plug 55 providing power to power tools while in the attic or other cramped space. The lighting may be operated independently of this switch 60 or may be equipped with a separate switch.

A clip for an extension cord 56 will be provided in close proximity to the power cord 65. Additionally, because safety is of utmost concern, there will also be a ground fault circuit interrupter outlet or other type of surge protection device incorporated into the plug 55. This would prevent a power surge, which may cause injury to the worker or damage to the tool.

This device 5 will be exposed to a variety of environmental conditions including hot and cold environments, as well as dirty environments. As such, the device would be made from durable material and hard plastic or aluminum is preferable. Other materials, however, may be considered in the construction of this device.

The inventor claims:

1. A toolbox with special features, which is comprised of:

a. a top surface;

b. a bottom surface;

c. two long flat surfaces;

d. two short flat surfaces;

wherein the device will be in the general shape of a rectangle;

e. handle;

wherein the handle is placed on the top surface to carry the device;

f. drawers;

wherein a plurality of drawers is provided on one of the long flat surfaces;

wherein a locking means is provided for the drawers;

g. tool attachment clips;

wherein a plurality of tool attachment clips is provided on one of the long flat surfaces opposite from the drawers;

h. lighting source;

wherein the lighting source is secured to the device on one of the short flat surfaces;

wherein a clear cover for the lighting source is provided;

i. propane torch holder;

wherein the propane torch holder is secured to the device on one of the short flat surfaces opposite from the lighting source;

wherein the propane torch holder is provided with a latch;

wherein the propane torch holder is adjustable;

j. a shelf;

wherein the shelf is a flat long surface;

wherein the shelf is attached to the toolbox to the bottom surface with a securing device;

wherein the shelf can be removed from the toolbox;

said shelf is allowed to operate independently of the toolbox if it is removed;

k. hinges;

wherein a plurality of hinges is provided on the bottom of the device to remove the base from the toolbox;

l. power cord;

m. plug;

wherein a plug is provided to provide power to tools;

n. an on/off switch;

wherein the on/off switch allows power to a power tool.

2. The device as described in claim 1 wherein the lighting source is a plurality of fluorescent lights.

3. The device as described in claim 1 wherein the lighting source is a plurality of incandescent lights.

4. The device as described in claim 1 wherein the securement device for the drawers are latches.

5. The device as described in claim 1 wherein the securement device for the drawers are clips.

6. The device as described in claim 1 wherein the tool attachment clips accommodate screwdrivers.

7. The device as described in claim 1 wherein the tool attachment clips accommodate pliers.

8. The device as described in claim 1 wherein the tool attachment clips accommodate wrenches.

* * * * *